US008403194B2

(12) United States Patent
Tebo

(10) Patent No.: US 8,403,194 B2
(45) Date of Patent: Mar. 26, 2013

(54) TOOL POSITIONING SYSTEM FOR POSITIONING POWER FASTENER TOOLS

(76) Inventor: Glenn J. Tebo, Kingston, NH (US)

( * ) Notice: Subject to any disclaimer, the term of this patent is extended or adjusted under 35 U.S.C. 154(b) by 358 days.

(21) Appl. No.: 12/708,904

(22) Filed: Feb. 19, 2010

(65) Prior Publication Data

US 2010/0213237 A1 Aug. 26, 2010

Related U.S. Application Data

(60) Provisional application No. 61/154,301, filed on Feb. 20, 2009.

(51) Int. Cl.
*B25C 7/00* (2006.01)

(52) U.S. Cl. ..... 227/148; 227/147; 227/153; 227/156; 227/119; 269/37

(58) Field of Classification Search ..... 227/147, 227/148, 153, 156, 119; 269/37
See application file for complete search history.

(56) References Cited

U.S. PATENT DOCUMENTS

| | | | | |
|---|---|---|---|---|
| 3,007,171 | A * | 11/1961 | Critchley | 227/109 |
| 3,864,053 | A * | 2/1975 | Harwood | 408/110 |
| D488,373 | S | 4/2004 | Eberle | |
| 6,851,884 | B2 | 2/2005 | Eberle | |
| 7,044,460 | B2 * | 5/2006 | Bolton | 269/37 |
| D573,454 | S | 7/2008 | Eberle, III | |
| 7,578,105 | B2 | 8/2009 | Eberle, III | |
| 2003/0024962 | A1 * | 2/2003 | Sims et al. | 227/148 |
| 2007/0257081 | A1 * | 11/2007 | Dion et al. | 227/148 |
| 2008/0279654 | A1 | 11/2008 | Deschamps | |

* cited by examiner

*Primary Examiner* — M. Alexandra Elve
*Assistant Examiner* — Michelle Lopez
(74) *Attorney, Agent, or Firm* — Grossman, Tucker, Perreault & Pfleger, PLLC

(57) ABSTRACT

A system and method for positioning a tool. The system includes a base member configured to contact a first decking member and a second decking member; at least one base guide including a first end and an opposing second end, the first end coupled to the base member, the at least one base guide configured to position the base member relative to the first decking member and the second decking member; and an adjustable section coupled to the base member, the adjustable section configured to allow adjustment of at least one of a position and an angle of the tool relative to the base member.

15 Claims, 5 Drawing Sheets

TOOL POSITIONING SYSTEM FOR POSITIONING POWER FASTENER TOOLS

CROSS-REFERENCE TO RELATED APPLICATIONS

This application claims the benefit of U.S. provisional patent application Ser. No. 61/154,301, filed Feb. 20, 2009, the entire disclosure of which is incorporated herein by reference.

FIELD

The present invention relates in general to tool positioning system for positioning power fastener tools.

BACKGROUND

A wide variety of fastener configurations for securing structural members to other members are known. In one example, a deck fastener may be used for securing decking members to associated joists in the construction of an exterior deck, or the like. It is desirable that deck fasteners be configured for securing decking members to associated joists without a fastener head protruding from a visible deck surface. It is also desirable to position a first decking member relative to an adjacent decking member, e.g., with a space (gap), between the first decking member and the adjacent decking member. The gap is configured to allow for and/or accommodate expansion and/or contraction of the decking members due to, for example, variations in environmental conditions, e.g., temperature and/or humidity. Deck fasteners may be driven into a decking member so that a head of the fastener is not visible from a deck top surface, e.g., by driving the deck fastener at an angle into an edge of a decking member and into an associated joist.

Fasteners may be driven into decking members using, e.g., a power fastening tool. The power fastening tool may be positioned at an angle relative to the decking member in order to drive the fastener, at an angle, into the edge of the decking member and into the associated joist. The gap may facilitate driving the fastener into the edge of the decking member. To achieve improved efficiency in driving the fasteners into the edge of the decking member at a desired angle, there is a need for an improved system and method for positioning a fastening tool relative to the decking member(s).

BRIEF DESCRIPTION OF THE DRAWINGS

For a better understanding of the present invention, together with other objects, features and advantages, reference should be made to the following detailed description which should be read in conjunction with the accompanying figures, wherein.

DETAILED DESCRIPTION

For ease of explanation, systems consistent with the present disclosure may be shown and described herein in connection a nail-type fastener. It will be recognized, however, a system and method consistent with the present disclosure will be useful in connection with a wide variety of fastener configurations. In addition, exemplary embodiments may be described herein in connection with fastening decking members to associated joists. It is to be understood, however, that a system and method consistent with the present disclosure may be useful in connection with fasteners configured for use with any type of material including wood, composite materials, concrete, metal, plastic, textiles and other materials. The exemplary embodiments described herein are thus provided only by way of illustration, and are not intended to be limiting.

Generally, the present disclosure relates to a tool positioning system and method configured for positioning a power fastener tool ("tool") for driving a fastener into an edge of a decking member to secure the decking member to an associated joist. For example, the power fastener tool may be power nailer (e.g., pneumatic, internal combustion and/or electric), a power stapler (e.g., pneumatic and/or electric) or another fastener system, e.g., screw fastener system, and may include a magazine of fasteners. The tool positioning system may include a base member, at least one base guide coupled to the base member and an adjustable section coupled to the base member. The adjustable section is configured to facilitate positioning and/or orienting the power fastener tool relative to the base member and/or a decking member. For example, the adjustable section may include at least one pivot member, e.g. pivot shaft, and a corresponding shaft guide.

Positioning may include translation of the power fastener tool relative to the base member. Orienting may include rotation of said power fastener tool relative to the base member. Rotation is configured to adjust a drive angle of a fastener relative to a decking member. Translation is configured to adjust a position of a nose of the power fastener tool in order to position the nose relative to the edge of the decking member, e.g., to position the fastener relative to the edge of the decking member and/or to release a safety mechanism to allow the tool to drive the fastener into the decking member.

Figure 1A:
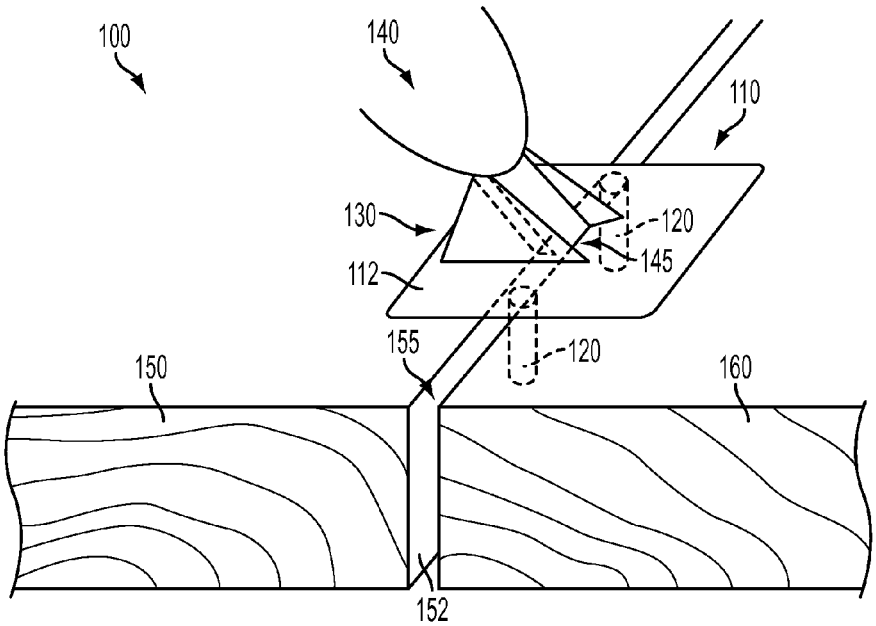
FIG. 1A is a sketch of one embodiment of a tool positioning system with a fixed angle consistent with the present disclosure.
Figure 1B:
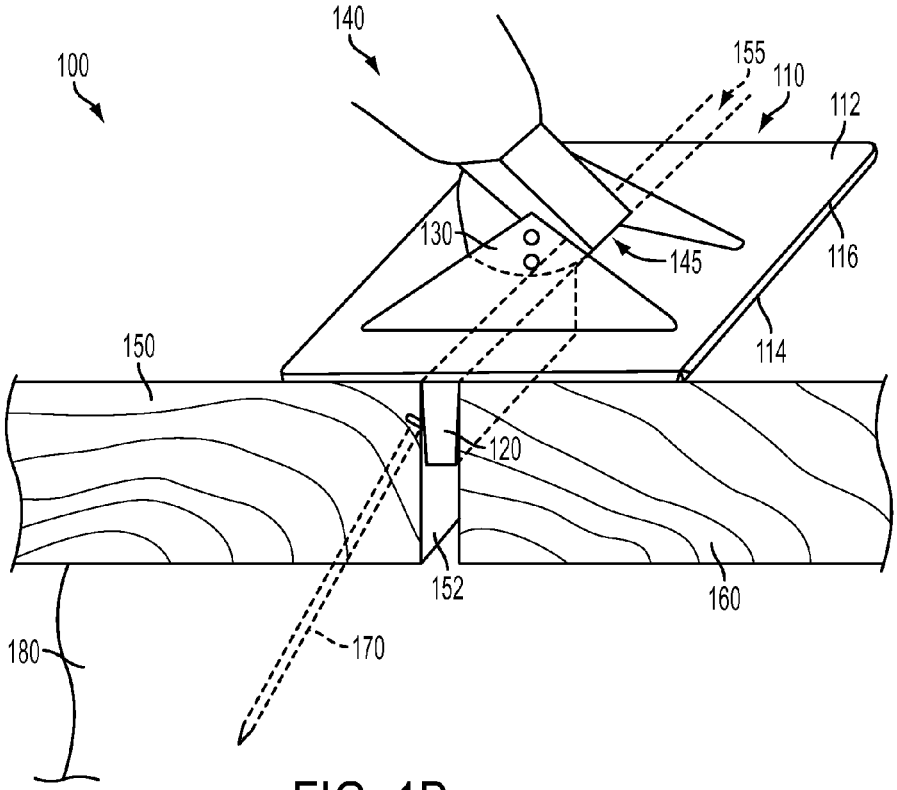
FIG. 1B is a sketch of another embodiment of a tool positioning system with an adjustable angle consistent with the present disclosure.
Figure 1C:
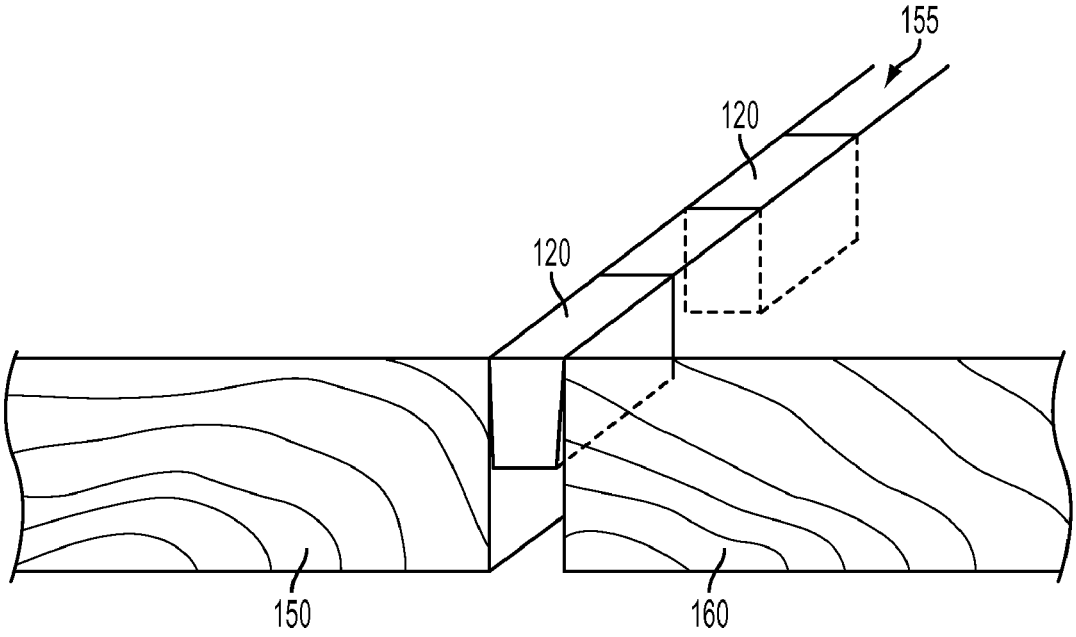
FIG. 1C is a sketch illustrating a plurality of base guides.

Turning to FIGS. 1A through 1C, there is illustrated sketches of exemplary embodiments of a tool positioning system 100 consistent with the present disclosure. The exemplary systems 100 include a base member 110, at least one base guide 120 coupled to the base member 110 and an adjustable section 130 coupled to the base member 110. A tool 140 may be coupled to the adjustable section 130.

The base member 110 may include a first surface 112, a second surface 114 and at least one side 116. The first surface 112 and the second surface 114 may be generally planar. The first surface 112 may be generally parallel to the second surface 114. The side 116 may be generally perpendicular to the first surface 112 and the second surface 114. The second surface 114 may contact a first decking member 150 and/or a second decking member 160, adjacent the first decking member 150, when the tool positioning system 100 is in place, e.g., in preparation for driving one or more fasteners into the decking member(s). The first surface 112 may then correspond to a top surface and the second surface 114 may then correspond to a bottom surface of the base member 110.

For example, the base member 110 may be generally rectangular, i.e., the first surface 112 and the second surface 114 may be generally rectangular. The base member 110 may have a width in a range of about one inch to about 8 inches. The base member 110 may have a length in a range of about one inch to about 8 inches. The base member 110 may define an opening configured to receive a tool nose 145, i.e., a discharge end of the tool 140, as described herein.

At least one base guide 120 may be coupled to the second (bottom) surface 114 of the base member 110. The base guide(s) 120 are configured to position the tool positioning system 100 relative to the decking members 150, 160. The base guide(s) 120 are configured to provide and/or fit into a space ("gap") 155 between the first decking member 150 and the second decking member 160, adjacent the first decking member 150. The base guide(s) 120 may facilitate positioning the tool positioning system 100 relative to the decking member(s) and may inhibit movement of the tool positioning system 100, e.g., when a fastener 170 is driven into a decking member.

The base guide(s) 120 may have a first end coupled to the base member 110 and an opposing second end. In some embodiments, at least a portion of the base guide 120 adjacent the second end may be tapered to facilitate inserting the base guide 120 into the gap 155 between the decking members 150, 160. In an embodiment with a plurality of base guides 120, the adjustable section 130 may be positioned generally between at least two of the plurality of base guides 120. This configuration may provide relatively stable support for the tool positioning system 100 on the decking members.

For example, the base guide(s) 120 may be generally cylindrically shaped, i.e., may have a generally circular cross section. In another example, the base guide(s) 120 may be generally rectangular shaped, i.e., may have a generally rectangular cross-section. A dimension of the base guide cross-section, corresponding to the gap 155 between the first decking member 150 and the second decking member 160, may be in a range of about 0.062 inches to about one inch. Although cylindrical and rectangular shapes have been described, consistent with the present disclosure, the base guide(s) are not limited to these shapes.

The adjustable section 130 is configured to provide translation and, in some embodiments, rotation of the tool nose 145 relative to the base member 110, e.g., relative to the second (bottom) surface 114 of the base member 110 and, thereby relative to the first 150 and second 160 decking members. As shown, for example, in FIG. 1B, a fastener 170 may be driven into an edge 152 of a decking member, e.g., the first decking member 150, and into an associated joist 180. In order to drive the fastener 170 into the edge 152 of the decking member, the tool nose 145 may be positioned at least partially in the gap 155 and at an angle relative to a perpendicular defined relative to a surface of the joist 180. The surface of the joist may be generally parallel to the first 112 and/or second surface 114 of the base member 110 when the base member 110 is in contact with the decking members 150, 160. The adjustable section 130 is configured to provide translation of the tool nose 145 so that the tool nose 145 may be positioned at least partially in the gap 155. The tool nose 145 may generally be biased, by, e.g., a spring, so that the tool nose 145 is not in the gap 155. The tool nose 145 may be inserted into the gap 155 by applying a force to the tool 140. In the embodiment shown in FIG. 1A, the adjustable section 130 is configured to provide a fixed angle for the tool nose 145 relative to the base member 110. In the embodiment shown in FIG. 1B, the adjustable section 130 is configured to provide an adjustable angle of the tool nose 145 relative to the base member 110. For example, the angle may be in a range of about 89 degrees to about 30 degrees relative to the base member 110. In other words, the angle may be in a range of about one degree to about 60 degrees relative to a perpendicular to the surface of the joist 180. A tool nose 145 angle perpendicular to the surface of the joist 180 may result in driving the fastener 170 into the joist 180 and not into a decking member 150, 160, when the tool nose 145 is positioned at least partially in the gap 155.

Figure 2A:
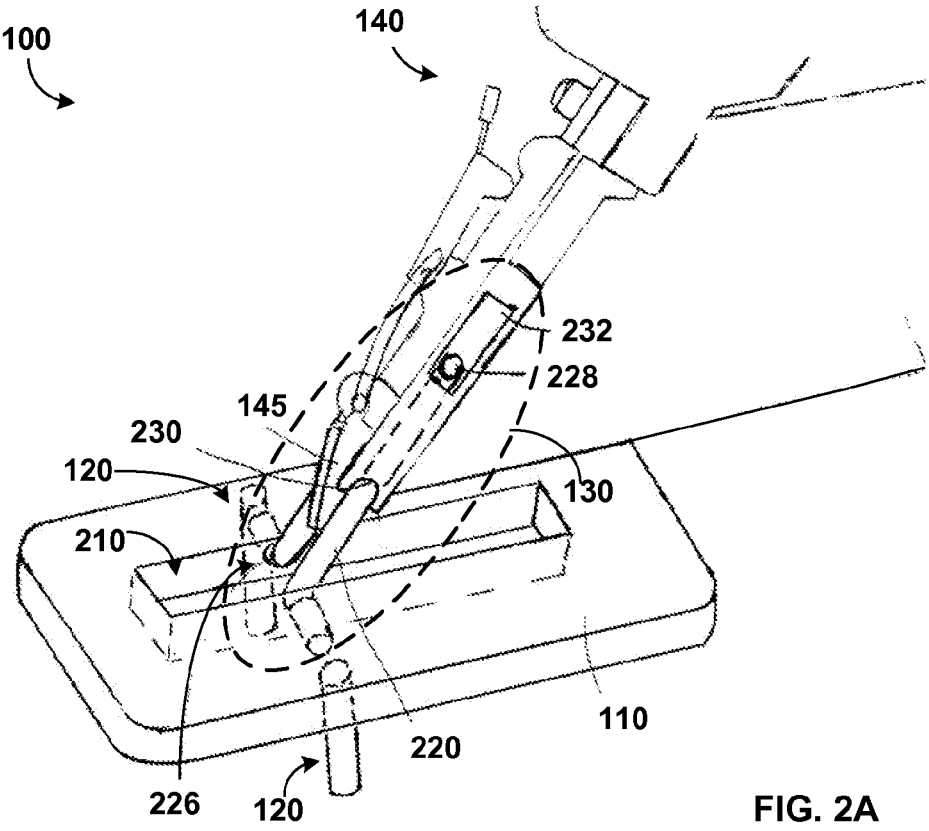
FIG. 2A is a sketch of one exemplary embodiment of a tool positioning system consistent with the present disclosure.
Figure 2B:
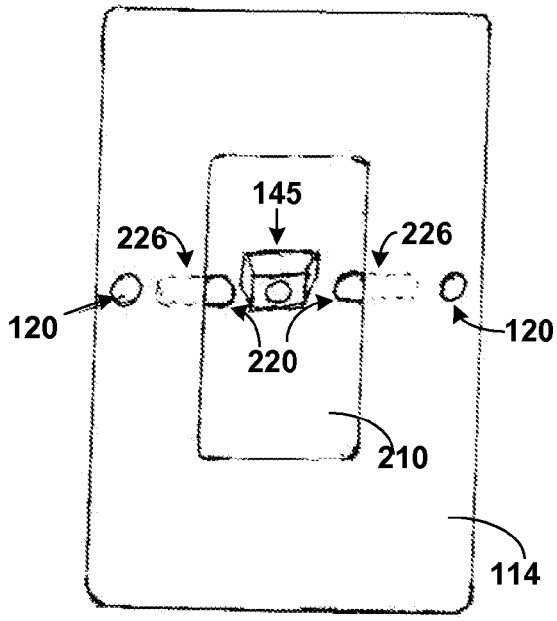
FIG. 2B is a bottom view of the exemplary embodiment of FIG. 2B.
Figure 2C:
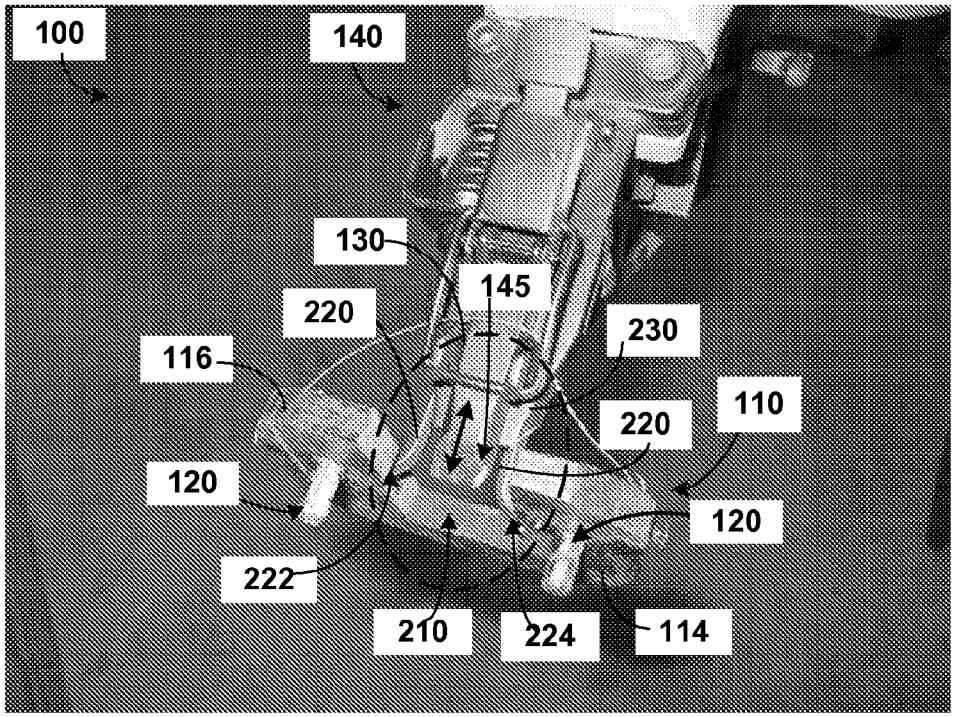
FIG. 2C depicts one exemplary embodiment of a tool positioning system consistent with the present disclosure.

Turning to FIGS. 2A through 2C, there is illustrated an example of a tool positioning system 100, consistent with the present disclosure. In this example, the tool positioning system 100 includes two generally cylindrical base guides 120 coupled to a second surface 114 of a generally rectangular base member 110. The base member 110 defines a generally rectangular opening 210 configured to receive the tool nose 145. The tool positioning system 100 includes an adjustable section 130, delineating in the FIGS. 2A and 2C by a dotted ellipse. Translation of the tool nose 145, i.e., adjustment of the tool nose 145 relative to the base member 110, is illustrated by a line with an arrow at each end in FIG. 2C.

Continuing with this example, the adjustable section 130 includes a plurality of pivot members, e.g., pivot shafts 220, and a plurality of corresponding shaft guides 230. The pivot shafts 220 are configured to provide rotation of the tool nose 145, i.e., adjustment of an angle of the tool nose 145, relative to the base member 110. The pivot shafts 220 may be slidably coupled to the base member 110 via pivot shaft openings 226 defined in based member 110. An axis of rotation may be defined between a first pivot point 222 and a second pivot point 224, generally parallel to the second surface 114 of the base member 110. The tool nose 145 (and tool 140) may rotate generally about this axis.

The pivot shafts 220 and the corresponding shaft guides 230 are configured to provide translation of the tool nose 145 relative to the base member 110 and thereby decking members 150, 160. For example, each pivot shaft 220 may be slidably coupled to an associated shaft guide 230. The shaft guides may be coupled to the tool 140 such that the tool 140 may move along the pivot shafts relative to the base member 110, as indicated by the double arrow in FIG. 2C. In some embodiments, the pivot shaft(s) 220 may be configured to disengage a safety feature and allow the tool 140 to drive a fastener when the tool nose 145 is moved relative to the base member 110 and contacts, e.g., the edge 152 of the first decking member 150.

In some embodiments, the shaft guides 230 may define a shaft guide opening 232 configured to allow insertion and/or removal of a pivot shaft retainer 228. The pivot shaft retainer 228 is configured to retain the pivot shaft 220 in the pivot shaft guide 230. For example, the pivot shaft retainer 228 may be a retainer clip, known to those skilled in the art.

Figure 3A:
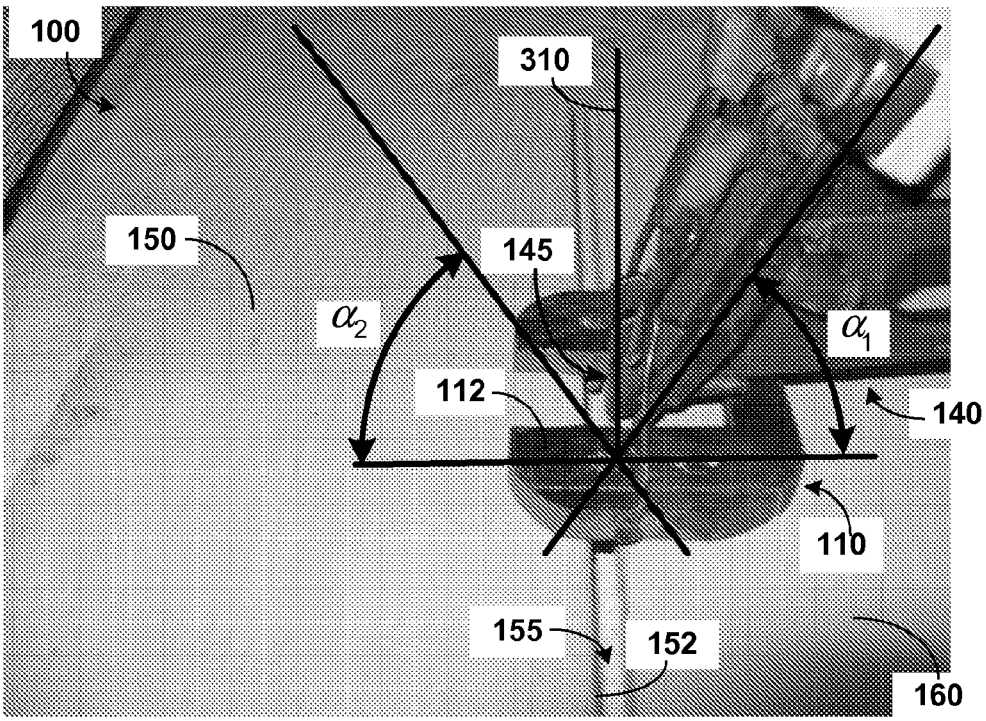
FIG. 3A depicts the exemplary embodiment of FIG. 2C with the tool at an angle and the tool nose adjacent to a gap.
Figure 3B:
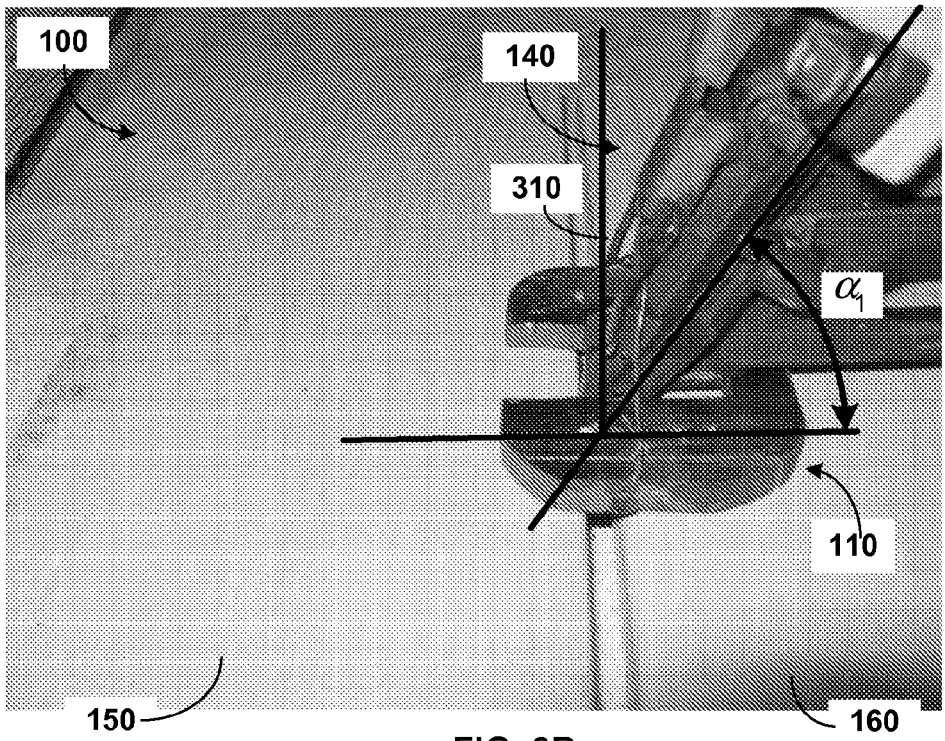
FIG. 3B depicts the exemplary embodiment of FIG. 2C with the tool at an angle and the tool nose partially inserted into the gap.
Figure 3C:
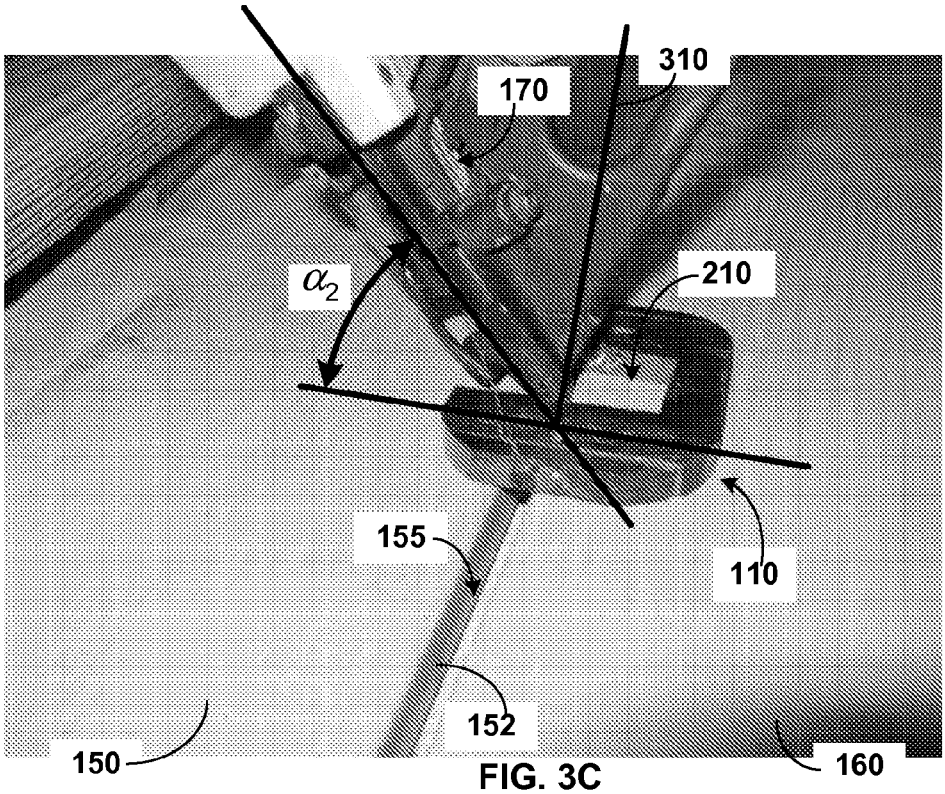
FIG. 3C depicts the exemplary embodiment of FIG. 2C with the tool at another angle and the tool nose partially inserted into the gap.

Turning to FIGS. 3A through 3C, there is illustrated the exemplary tool positioning system 100 of FIG. 2C with the tool 140 positioned relative to a base member 110, decking members 150, 160 and gap 155. Referring first to FIG. 3A, there is illustrated the tool 140 with tool nose 145 positioned near the gap 155. In this example, the base guides 120 are positioned at least partially in the gap 155 between the first and second decking members 150, 160, and the second surface 114 of the base member 110 is contacting the decking members 150, 160. The tool 140 and tool nose 145 are at an angle $\alpha_1$ relative to the base member 110. A reference perpendicular 310 is illustrated. The reference perpendicular 310 is relative to the first surface 112 of the base member 110 which may be generally parallel to a surface of the joist 180. The adjustable section 130 may allow rotation of the tool 140 and/or tool nose 145 to an angle $\alpha_2$ relative to the base member 110. Positioning tool 140 at angle $\alpha_1$ relative to the base member 110 may allow a fastener to be driven into the first decking member 150 while positioning tool 140 at angle $\alpha_2$ relative to the base member 110 may allow a fastener 170 to be driven into the second decking member 160.

Referring now to FIG. 3B, there is illustrated the tool positioning system 100 and the tool 140 with the tool nose 145 positioned at angle $\alpha_1$ with the tool nose 145 positioned at least partially in the gap 155, in preparation for driving a fastener 170 into the first decking member 150. Referring now to FIG. 3C, there is illustrated the tool positioning system 100 and the tool 140 with the tool nose 145 positioned at angle $\alpha_2$ with the tool nose 145 positioned at least partially in the gap 155, in preparation for driving a fastener 170 into the second decking member 160.

For example, a tool positioning system 100 may be utilized to secure one or more decking members to associated joists. The first decking member 150 and the second decking member 160 may be placed, i.e., positioned, on a plurality of joists 180. The second decking member 160 may be positioned relative to the first decking member 150, leaving a gap 155 between the decking members 150, 160. The tool positioning system 100 may then be positioned relative to the decking members 150, 160 so that the one or more guide members 120 extend at least partially into the gap 155 and the base member 110 contacts the decking members 150, 160. An angle, e.g., $\alpha_1$, between the tool 140 (and tool nose 145) and the base member 110 may be adjusted to align the tool nose 145 relative to the edge 152 of the first decking member 150. In some embodiments, the angle may be set prior to positioning the tool positioning system 100 relative to the decking members 150, 160. A position of the tool 140 may then be adjusted to position the tool nose 145 in the gap 155. In this position, the tool nose 145 may contact the edge 152 of the first decking member 150 and may disengage the safety feature and allow a fastener to be driven into the first decking member 150 and the associated joist, e.g., joist 180. The tool 140 may then be released so that the tool nose 145 exits the gap. In some embodiments the tool 140 may be rotated to a second angle, e.g., $\alpha_2$, between the tool 140 (and tool nose 145) and the base member 110. The process may then be repeated to drive a fastener into the second decking member 160. The tool positioning system 100 may then be moved to another position, e.g., another associated joist, along the decking members 150, 160 and the process may be repeated.

Accordingly, a tool positioning system, consistent with the present disclosure, is configured to position a power fastener tool to facilitate driving a fastener into an edge of a decking member and into an associated joist. The tool positioning system is configured to provide rotation and/or translation of the tool relative to decking member(s) and/or a gap between decking members. In this manner, driving fasteners during the installation of decking members may be done relatively quickly while reducing the likelihood that the fasteners will be visible after the installation.

According to one aspect, there is disclosed a system for positioning a tool. The system may include a base member configured to contact a first decking member and a second decking member. The system may further include at least one base guide including a first end and an opposing second end, the first end coupled to the base member, the at least one base guide configured to position the base member relative to the first decking member and the second decking member. The system may further include an adjustable section coupled to the base member, the adjustable section including at least one pivot shaft and at least one corresponding shaft guide slidably coupled to the at least one pivot shaft, the at least one pivot shaft configured to pivot about a pivot point allowing adjustment of an angle of the tool relative to the base member, the at least one corresponding shaft guide configured to allow adjustment of a position of the tool along the at least one pivot shaft, relative to the base member.

According to another aspect, there is provided a system for positioning a tool. The system may include a base member configured to contact a first decking member and a second decking member. The system may further include at least one base guide including a first end and an opposing second end, the first end coupled to the base member, the at least one base guide configured to position the base member relative to the first decking member and the second decking member. The system may further include an adjustable section coupled to the base member, the adjustable section configured to allow adjustment of at least one of a position and an angle of the tool relative to the base member.

According to another aspect, there is provided a method for positioning a tool. The method may include positioning a tool positioning system relative to a first decking member and a second decking member. The tool positioning system may include a base member configured to contact the first decking member and the second decking member, at least one base guide including a first end and an opposing second end, the first end coupled to the base member, the at least one base guide configured to position the base member relative to the first decking member and the second decking member, and an adjustable section coupled to the base member, the adjustable section configured to allow adjustment of at least one of a position and an angle of a tool relative to the base member. The positioning may include inserting the at least one base guide at least partially into a gap between the first decking member and the second decking member until the base member contacts the first decking member and the second decking member; and adjusting the position of the tool relative to the base member so that the nose of the tool contacts the edge of the first decking member, disengaging a safety feature and allowing a fastener to be driven into the first decking member and an associated joist by the tool.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible.

What is claimed is:

1. A system for positioning a tool comprising:

a base member having a top surface and a bottom surface, said bottom surface configured to contact a first decking member and a second decking member;

at least one base guide comprising a first end and an opposing second end, said first end coupled to said bottom surface of said base member, said at least one base guide configured to extend between said first decking member and said second decking member and position and inhibit movement of said base member relative to said first decking member and said second decking member; and an adjustable section coupled to said base member, said adjustable section configured to allow adjustment of at least one of a position and an angle of said tool relative to said base member.

2. A system according to claim 1, wherein said angle is between 30 degrees and 89 degrees.

3. A system according to claim 1, wherein a dimension of a cross-section of said at least one base guide is between 0.062 inches and one inch.

4. A system according to claim 1, wherein said system comprises a plurality of base guides.

5. A system according to claim 1, wherein said angle is fixed.

6. A system according to claim 1, wherein said base member is generally rectangular and said base member has a width dimension between one inch and eight inches and a length dimension between one inch and eight inches.

7. A system according to claim 1, wherein at least a portion of said at least one base guide is tapered adjacent said second end.

8. A system for positioning a tool comprising:

a base member configured to contact a first decking member and a second decking member;

at least one base guide comprising a first end and an opposing second end, said first end coupled to said base member, said at least one base guide configured to position said base member relative to said first decking member and said second decking member; and an adjustable section coupled to said base member, said adjustable section comprising at least one pivot shaft and at least one corresponding shaft guide slidably coupled to said at least one pivot shaft, said at least one pivot shaft configured to pivot about a pivot point allowing adjustment of an angle of said tool relative to said base member, said at least one corresponding shaft guide configured to allow adjustment of a position of said tool along said at least one pivot shaft, relative to said base member.

9. A system for positioning a tool comprising:

a base member configured to contact a first decking member and a second decking member;

at least one base guide comprising a first end and an opposing second end, said first end coupled to said base member, said at least one base guide configured to position said base member relative to said first decking member and said second decking member; and an adjustable section coupled to said base member and configured to allow adjustment of at least one of a position and an angle of said tool relative to said base member, said adjustable section comprising at least one pivot shaft and at least one corresponding shaft guide slidably coupled to said at least one pivot shaft, said at least one pivot shaft configured to pivot about a pivot point allowing adjustment of said angle of said tool relative to said base member, said at least one corresponding shaft guide configured to allow adjustment of said position of said tool along said at least one pivot shaft, relative to said base member.

10. A system according to claim 9, wherein said angle is between 30 degrees and 89 degrees.

11. A system according to claim 9, wherein a dimension of a cross-section of said at least one base guide is between 0.062 inches and one inch.

12. A system according to claim 9, wherein said system comprises a plurality of base guides.

13. A system according to claim 9, wherein said angle is fixed.

14. A system according to claim 9, wherein said base member is generally rectangular and said base member has a width dimension between one inch and eight inches and a length dimension between one inch and eight inches.

15. A system according to claim 9, wherein at least a portion of said at least one base guide is tapered adjacent said second end.

* * * * *